US010415496B2

(12) United States Patent
Yamaguchi et al.

(10) Patent No.: US 10,415,496 B2
(45) Date of Patent: Sep. 17, 2019

(54) HANDHELD ENGINE-DRIVEN WORKING MACHINE

(71) Applicants: YAMABIKO CORPORATION, Ohme-shi, Tokyo (JP); IIDA DENKI KOGYO Co., Ltd., Mitaka-shi, Tokyo (JP)

(72) Inventors: Shiro Yamaguchi, Ohme (JP); Takamasa Otsuji, Ohme (JP); Kosuke Matsumoto, Ohme (JP); Hiroyuki Miyaki, Ohme (JP); Akira Yamazaki, Mitaka (JP)

(73) Assignees: YAMABIKO CORPORATION, Ohme-Shi, Tokyo (JP); IIDA DENKI KOGYO CO., LTD., Mitaka-Shi, Tokyo (JP)

( * ) Notice: Subject to any disclaimer, the term of this patent is extended or adjusted under 35 U.S.C. 154(b) by 132 days.

(21) Appl. No.: 15/134,013

(22) Filed: Apr. 20, 2016

(65) Prior Publication Data

US 2016/0312737 A1 Oct. 27, 2016

(30) Foreign Application Priority Data

Apr. 24, 2015 (JP) ..... 2015-089630

(51) Int. Cl.
*F02D 41/34* (2006.01)
*F02D 31/00* (2006.01)
(Continued)

(52) U.S. Cl.
CPC ..... *F02D 41/345* (2013.01); *F02B 63/02* (2013.01); *F02D 31/007* (2013.01);
(Continued)

(58) Field of Classification Search
CPC .. F02D 41/345; F02D 41/0097; F02D 31/007; F02D 35/0053; F02D 2400/06;
(Continued)

(56) References Cited

U.S. PATENT DOCUMENTS 3,822,685 A 7/1974 Nutten et al.
2004/0035390 A1* 2/2004 Nonaka ..... F02D 31/007 123/339.19

(Continued)

FOREIGN PATENT DOCUMENTS

JP 2013-204552 10/2013

OTHER PUBLICATIONS

European Search Report issued in European Patent Application No. 16166175.6 dated Sep. 23, 2016.

*Primary Examiner* — Hung Q Nguyen
*Assistant Examiner* — Brian P Monahon
(74) *Attorney, Agent, or Firm* — Baker & Hostetler LLP

(57) ABSTRACT

An engine-driven working machine includes a controller, which varies a control value of a solenoid valve so as to decrease or increase an opening degree of the solenoid valve when a rotating speed of an engine is within a predetermined high rotating speed range and the rotating speed of the engine is lower or higher than a predetermined rotating speed, respectively. When the control value of the solenoid valve is varied so as to decrease the opening degree of the solenoid valve and corresponds to a predetermined opening degree larger than a fully-closed state, the control value is set to a limitation value.

3 Claims, 6 Drawing Sheets

(51) Int. Cl.

| | |
|---|---|
| ***F02D 35/00*** | (2006.01) |
| ***F02D 41/00*** | (2006.01) |
| ***F02M 7/133*** | (2006.01) |
| ***F02M 7/22*** | (2006.01) |
| ***F02B 63/02*** | (2006.01) |

(52) U.S. Cl.
CPC ..... *F02D 35/0053* (2013.01); *F02D 41/0097* (2013.01); *F02M 7/133* (2013.01); *F02D 31/009* (2013.01); *F02D 35/0069* (2013.01); *F02D 2400/06* (2013.01); *F02M 7/22* (2013.01)

(58) Field of Classification Search
CPC .... F02D 31/009; F02D 35/0069; F02B 63/02; F02M 7/133; F02M 7/22
See application file for complete search history.

(56) References Cited

U.S. PATENT DOCUMENTS

| | | | | |
|---|---|---|---|---|
| 2010/0011597 | A1 | 1/2010 | Bo et al. | |
| 2011/0004395 | A1 | 1/2011 | Neubauer et al. | |
| 2013/0019840 | A1* | 1/2013 | Kawada | F02M 35/1019 123/348 |
| 2013/0112170 | A1* | 5/2013 | Yamashita | F02D 41/08 123/406.23 |
| 2013/0199812 | A1 | 8/2013 | Dangelmaier et al. | |
| 2013/0255629 | A1* | 10/2013 | Yamashita | F02M 17/00 123/439 |

* cited by examiner

HANDHELD ENGINE-DRIVEN WORKING MACHINE

FIELD OF THE INVENTION

The present invention relates to a handheld engine-driven working machine, specifically, to a handheld engine-driven working machine having an electronically controlled carburetor, such as a chain saw, an engine cutter, and a hedge trimmer.

BACKGROUND OF THE INVENTION

An output power of an engine of a handheld engine-driven working machine, such as a chain saw, varies due to variations of a carburetor and an engine and usage circumstances (for example, a temperature, an atmospheric pressure, a moisture, and a kind of fuel). In order to operate the engine at a predetermined designed output power (predetermined air-fuel ratio), the handheld engine-driven working machine having an electronically controlled carburetor has been known, and such a carburetor has a solenoid valve for adjusting an amount of supplying fuel into the carburetor (for example, see the Patent Publication 1). By changing a control value corresponding to an opening degree of the solenoid valve to adjust the amount of supplying fuel into the carburetor, the handheld engine-driven working machine can be operated at the predetermined designed output power.

Manufacturers of the handheld engine-driven working machines perform an operation with non-load (a completion operation) of the handheld engine-driven working machine before shipping it, and provisionally determine the above-stated control value for operating the engine at the designed output power (a control value for completion operation V0). On the other hand, after shipping the handheld engine-driven working machine, a circumstance in which the handheld engine-driven working machine is actually used is different from a circumstance in which the completion operation is performed, and for example, a temperature, an atmosphere pressure, and a kind of fuel may vary. For this reason, in an operation under the usage circumstance (an actual operation), the above-stated control value for operating the engine at the designed output power (an actual operation control value) is different from the control value for completion operation V0. Thus, it is advantage that the actual operation control value is determined in the actual operation.

The Patent Publication 1 describes a handheld engine-driven working machine which automatically determines the actual operation control value. Briefly, the handheld engine-driven working machine is operated with non-load under a usage circumstance, and a PI control for a control value corresponding to an opening degree of the solenoid valve is performed so that a rotating speed of the engine when a throttle is fully opened becomes a target rotating speed. In the PI control, a PI calculation is performed by using a difference between a current rotating speed and the target rotating speed and the control value is increased or decreased by a result of the PI calculation.

Specifically, after starting the engine, when the engine rotating speed is out of a predetermined engine rotating speed range, the PI control is not performed, and when the engine rotating speed is within the predetermined engine rotating speed range, the PI control is performed. Further, when the engine rotating speed is lower than the target rotating speed, the control value of the solenoid valve is varied so that the opening degree of the solenoid valve becomes smaller to make a fuel consumption lean, and when the rotating speed of the engine is higher than the target rotating speed, the control value of the solenoid valve is varied so that the opening degree of the solenoid valve becomes larger to make the fuel consumption rich. During a fixed number of continuous rotations, if the engine rotating speed is within a predetermined permissible range and the number of times of control implementations reaches a predetermined number of times, the PI control is finished and the control value at the finishing is determined as the actual operation control value.

FIG. 5 is a graph showing changes in the engine rotating speed and the control value with respect to time around a time when the actual operation control value was determined in an example where the actual operation of the chain saw with non load was performed while the control described in the Patent Publication 1 was performed. In this connection, the control value corresponding to the opening degree of the solenoid valve was determined so as to linearly change between 0 per mill (permillage) at a fully-opened solenoid valve and 1000 per mill at a fully-closed solenoid valve. Further, after starting the engine, the rotating speed of the engine was calculated per one rotation of the engine. Further, a racing operation was performed, in which an operation of fully opening the throttle for a several seconds and an operation of fully closing the throttle for a several seconds were alternately repeated.

In FIG. 5, after starting the engine, when the engine rotating speed was out of the predetermined rotating speed range (11000-14000 rpm) (A5), the PI control was not performed, and when it was within the predetermined rotating speed range (11000-14000 rpm) (B51, B52), the PI control was performed (C53). Further, when the rotating speed of the engine was within a range lower than the target rotating speed (12000 rpm) (B51), the control value was increased so that the opening degree of the solenoid valve was decreased to make the fuel consumption lean (C54), and when the rotating speed of the engine was within a range higher than the target rotating speed (12000 rpm) (B52), the control value was decreased so that the opening degree of the solenoid valve was increased to make the fuel consumption rich (C55). During a predetermined number of times of continuous rotations (for example, 5000 times), when the engine rotating speed was within a predetermined range (for example, 11500-12500 rpm) and the control value did not become changing (C56), the PI control was finished and the control value at the finishing was determined as the actual operation control value. Concretely, in the third operation shown in FIG. 5, during 5000 rotations, when the engine rotating speed was within the predetermined range (12000±500 rpm) and the number of times of the control implementations reached a predetermined number of times (30 times) (C56), the PI control was finished (C53') and the control value at the finishing was determined as the actual operation control value.

In the example shown in FIG. 5, when the throttle was fully opened, the engine rotating speed was increased to approximate 12000 rpm substantially without overshooting (C51). When the throttle was returned, the engine rotating speed was decreased to an idling rotating speed (C52). The fluctuation of the engine rotating speed was relatively small after the engine rotating speed was increased.

In this connection, a control value determined by manufacturers of the handheld engine-driven working machines in the above-stated way before shipping is the control value for completion operation and is used as a basic value.

PRIOR ART PUBLICATION

Patent Publication 1: Japanese Patent Laid-open Publication No. 2013-204552

SUMMARY OF THE INVENTION

In the method described in the Patent Publication 1, the racing operation with non-load is required to be performed for a certain period before working. However, an operator on a field may not perform the racing operation with non-load for the period required for determining the above-stated control value, namely, may get started working with load soon.

The inventors of the present application examined how the control described in the Patent Publication 1 would be if a working with load is started within the period required for determining the control value. FIG. 6 is a graph showing changes in the engine rotating speed and the control value with respect to time around a time when the actual operation control value was determined in an example where an actual operation of a chain saw was performed with load while the control described in the Patent Publication 1 was performed.

In FIG. 6, when the throttle was fully opened, the engine rotating speed was increased beyond 12000 rpm (C61). Then, when the chain saw got started cutting wood and so on (with load), the engine rotating speed was decreased below 12000 rpm (C62), and remained below 12000 rpm during the cutting. After the cutting is finished, the engine rotating speed was increased beyond 12000 rpm (C63), and when the throttle was returned, the engine rotating speed was decreased to an idling rotating speed (C64). In this situation, while the engine rotating speed was within a range of 11000-14000 rpm, the PI control was performed (C65). Namely, the control value was increased (C66) or decreased (C67) according to whether the rotating speed of the engine was smaller or larger than the target rotating speed, respectively. In the third operation shown in FIG. 6, the control value reached the maximum value (1000 per mill). In the fourth operation shown in FIG. 6, since during 5000 rotations, the engine rotating speed was within a predetermined range (12000±500 rpm) and the number of times of the control implementations reached a predetermined number of times (30 times) (C67), the PI control was finished (C65') and the control value at the finishing was determined as the actual operation control value.

As can be seen from FIG. 6, when the actual operation control value was determined in the operation with load, the control value was gradually increased, because the PI control was performed when the chain saw cut wood and so on and while the engine rotating speed was decreased. In this case, since the rotating speed of the engine was too high, it would be possible for the engine to become a dangerous state, such as seizure. The engine rotating speed was actually limited to an upper limitation value of 14000 rpm to prevent such a dangerous state, but there were events in which the engine rotating speed reached the upper limitation value. Further, there were also events in which the control value reached the maximum value of 1000 per mill. As a result, the actual operation control value determined in FIG. 6 became relatively larger than the actual operation control value to be determined with non-load. Namely, the amount of supplying fuel to the carburetor was not proper. In this connection, since the upper limitation value of the engine rotating speed was set, as shown in FIG. 6, when the actual operation with non-load was performed after the actual operation control value was determined, fluctuation of the engine rotating speed might be large (C69). Further, since the control value cannot go beyond 1000 per mill, there is a possibility to be out of control, when the actual operation control value becomes close to 1000 per mill.

Thus, the object of the present invention is to provide a handheld engine-driven working machine, in which even if an operator starts a working operation with load without performing an operation with non-load for a certain period required for determining the control value, an actual operation control value can be obtained not so far from the actual operation control value to be determined with non-load, and permissible stable rotations with non-load can be obtained.

In order to achieve the above-stated object, a handheld engine-driven working machine according to the present invention comprises an engine including an electronically controlled carburetor; and a controller connected to the electronically controlled carburetor; wherein the electronically controlled carburetor includes a solenoid valve for adjusting an amount of supplying fuel into the electronically controlled carburetor, wherein the controller varies a control value of the solenoid valve so as to decrease an opening degree of the solenoid valve when a rotating speed of the engine is within a predetermined high rotating speed range and the rotating speed of the engine is lower than a predetermined rotating speed; wherein the controller varies the control value of the solenoid valve so as to increase the opening degree of the solenoid valve when the rotating speed of the engine is within the predetermined high rotating speed range and higher than the predetermined rotating speed; and wherein when the control value of the solenoid valve is varied so as to decrease the opening degree of the solenoid valve and corresponds to a predetermined opening degree larger than a fully-closed state, the control value is set to a limitation value.

In the prior art control, when the engine-driven working machine is in a saw cutting operation, namely, in a state with load, even if the engine rotating speed is decreased lower than the target rotating speed, the PI control is performed, which should be applied in a state with non-load. Then, when the PI control is continued to be performed, the control value is gradually increased, and becomes relatively larger than a control value corresponding to the target rotating speed. As a result, when an operation with non-load is performed with the actual operation control value determined in the state with load, hunting of the engine rotating speed would be caused so that uncomfortable feeling may be given to an operator. On the contrary, in the handheld engine-driven working machine according to the present invention, although the decrease in the engine rotating speed at the saw cutting is incorporated into the PI control, an adverse effect on the PT control can be reduced by employing the limitation value of the control value. As a result, the actual operation control value determined in the state with load by the handheld engine-driven working machine according to the present invention is smaller than the actual operation control value determined in the state with load by the prior art handheld engine-driven working machine. Thus, when an operation with non-load is performed with the actual operation control value determined by the handheld engine-driven working machine according to the present invention, stable rotations in which fluctuation of the engine rotating speed is small can be obtained so that uncomfortable feeling does not given to the operator.

In an embodiment of the handheld engine-driven working machine according to the present invention, preferably, the limitation value is determined by varying a control value determined in a completion operation by a predetermined value toward a direction of opening the solenoid valve.

In an embodiment of the handheld engine-driven working machine according to the present invention, preferably, the engine-driven working machine is a chain saw, an engine cutter or a hedge trimmer.

According to the handheld engine-driven working machine according to the present invention, even if an operator gets started working with load without performing an operation with non-load for a certain period required for determining the control value, an actual operation control value can be obtained which is not so far from the actual operation control value to be determined with non-load, and permissible stable rotations with non-load can be obtained.

DETAILED DESCRIPTION OF EMBODIMENTS

Figure 1:
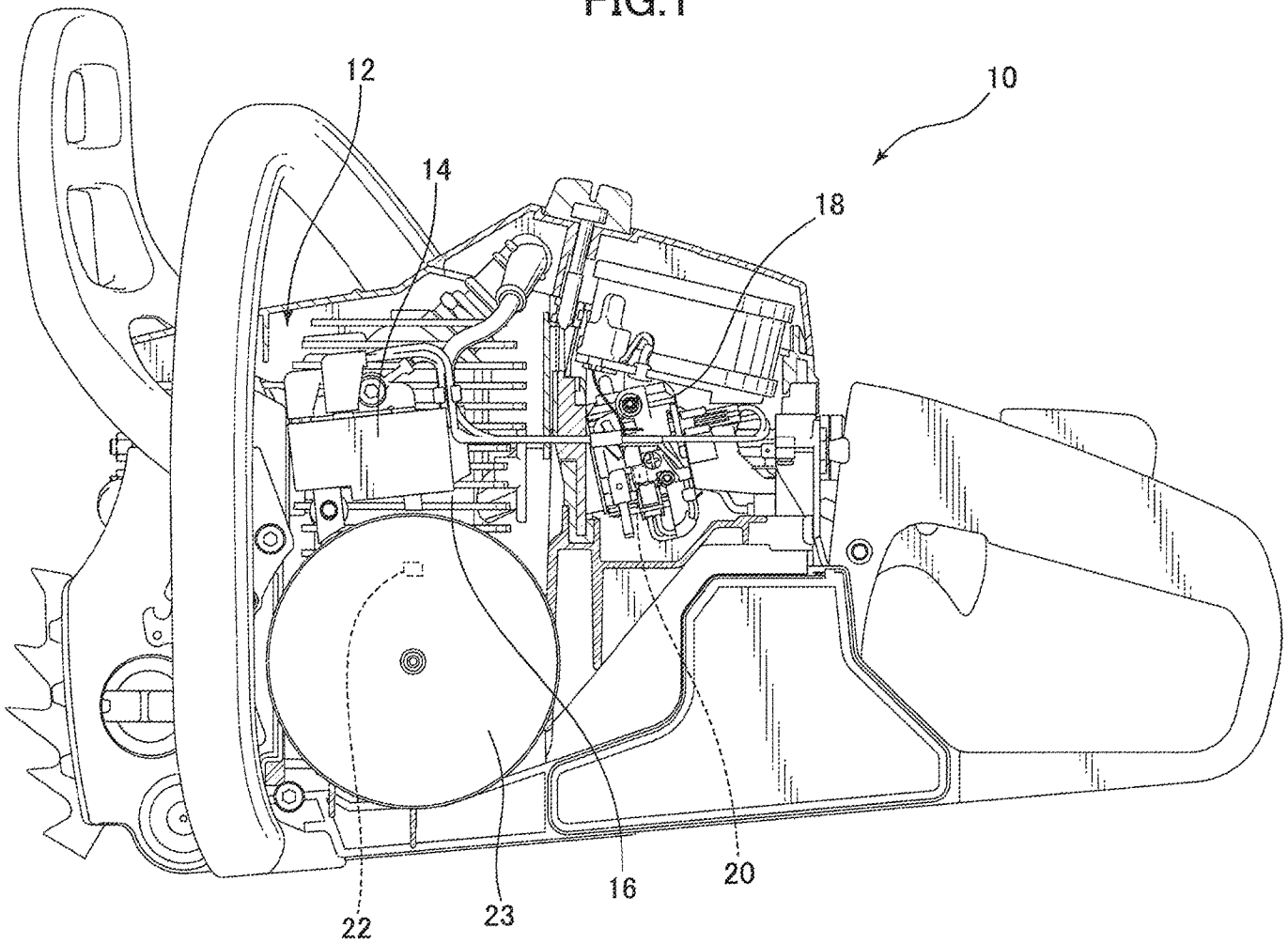
FIG. 1 is a side view of a chain saw according to the present invention in which a cover is omitted.

Referring to the drawings, an embodiment of a chain saw according to the present invention will be explained.

As shown in FIG. 1, a chain saw 10 has an engine 12 operated with gasoline fuel, and a controller 14 controlling the engine 12. The engine 12 has, at least, a cylinder block 16 and an electronically controlled carburetor 18. The carburetor 18 includes a solenoid valve 20 for adjusting an amount of supplying fuel into the carburetor 18, and the solenoid valve 20 is connected to the controller 14. Further, a detected object 22, such as a magnet, is attached to a flywheel 23, and the controller 14 is configured to detect the rotating speed of the engine 12 by using the detected object 22. Concretely, a period required for one rotation of the engine 12 is measured by detecting the detected object 22, and the rotating speed of the engine 12 is calculated per one rotation of the engine 12. In FIG. 1, chain blades are omitted.

Figure 2:
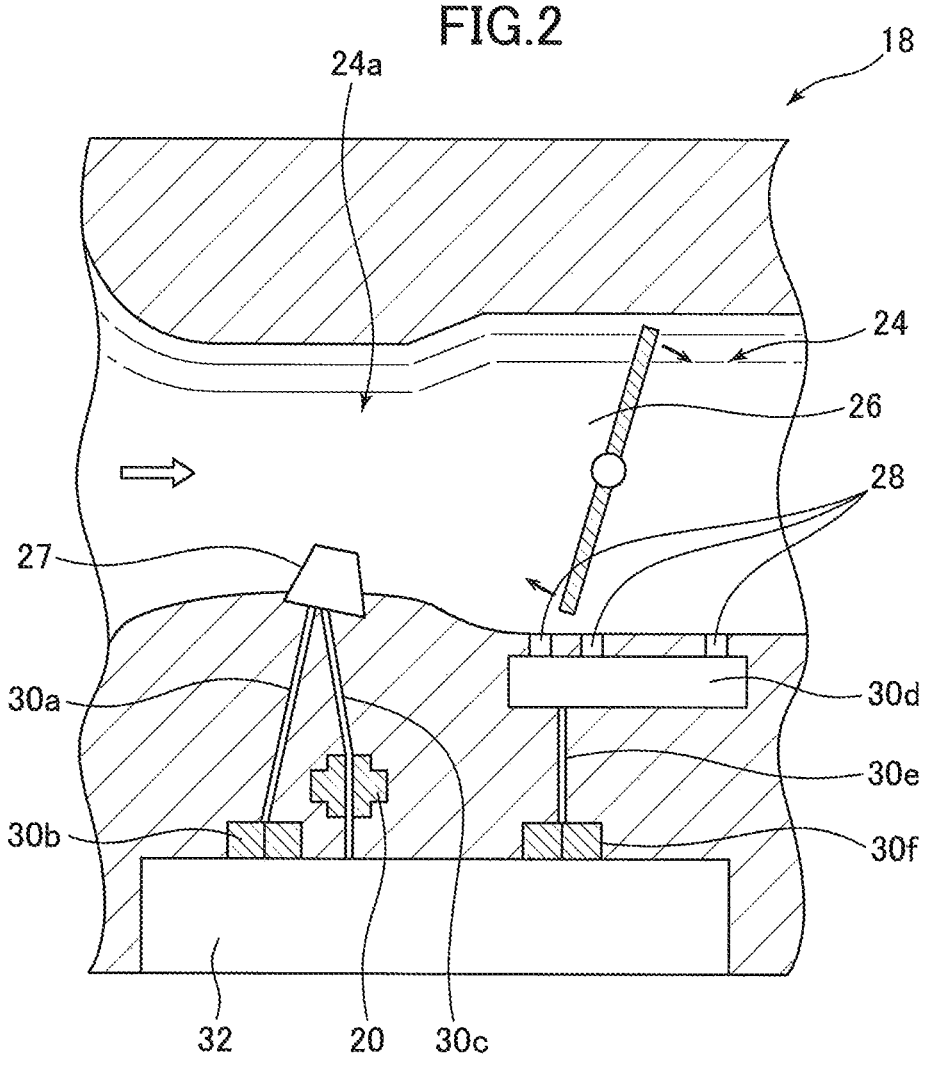
FIG. 2 is a schematic view showing an internal structure of a carburetor in the chain saw according to the present invention.

FIG. 2 is a schematic view showing an internal structure of the carburetor 18. As shown in FIG. 2, the carburetor 18 has a passage 24 including a Venturi section 24*a*, a throttle valve 26 provided in a passage downstream of the Venturi section 24*a*, a main fuel supply nozzle 27 disposed in the Venturi section 24*a*, and a slow-system (low speed) fuel supply port 28 disposed near the throttle valve 26. The main fuel supply nozzle 27 communicates with a metering chamber 32 through a first flow passage 30*a* and a fixed jet 30*b*, and communicates with a metering chamber 32 through a second flow passage 30*c* and the solenoid valve 20. The fuel supply port 28 communicates with the metering chamber 32 through a chamber 30*d*, a third flow passage 30*e* and the fixed jet 30*f*.

Fuel is supplied at a predetermined rate by a negative pressure of the engine through the main fuel supply nozzle 27 and the slow-system (low speed) fuel supply port 28. By adjusting an opening degree of the solenoid valve 20, an amount of fuel supplied through the main fuel supply nozzle 27 can be controlled, so that the entire amount of supplying fuel can be adjusted. In the present embodiment, a control value corresponding to the opening degree of the solenoid valve 20 is determined so as to linearly change between 0 per mill (permillage) when the solenoid valve 20 is fully-opened and 1000 per mill when the solenoid valve 20 is fully closed.

Figure 3:
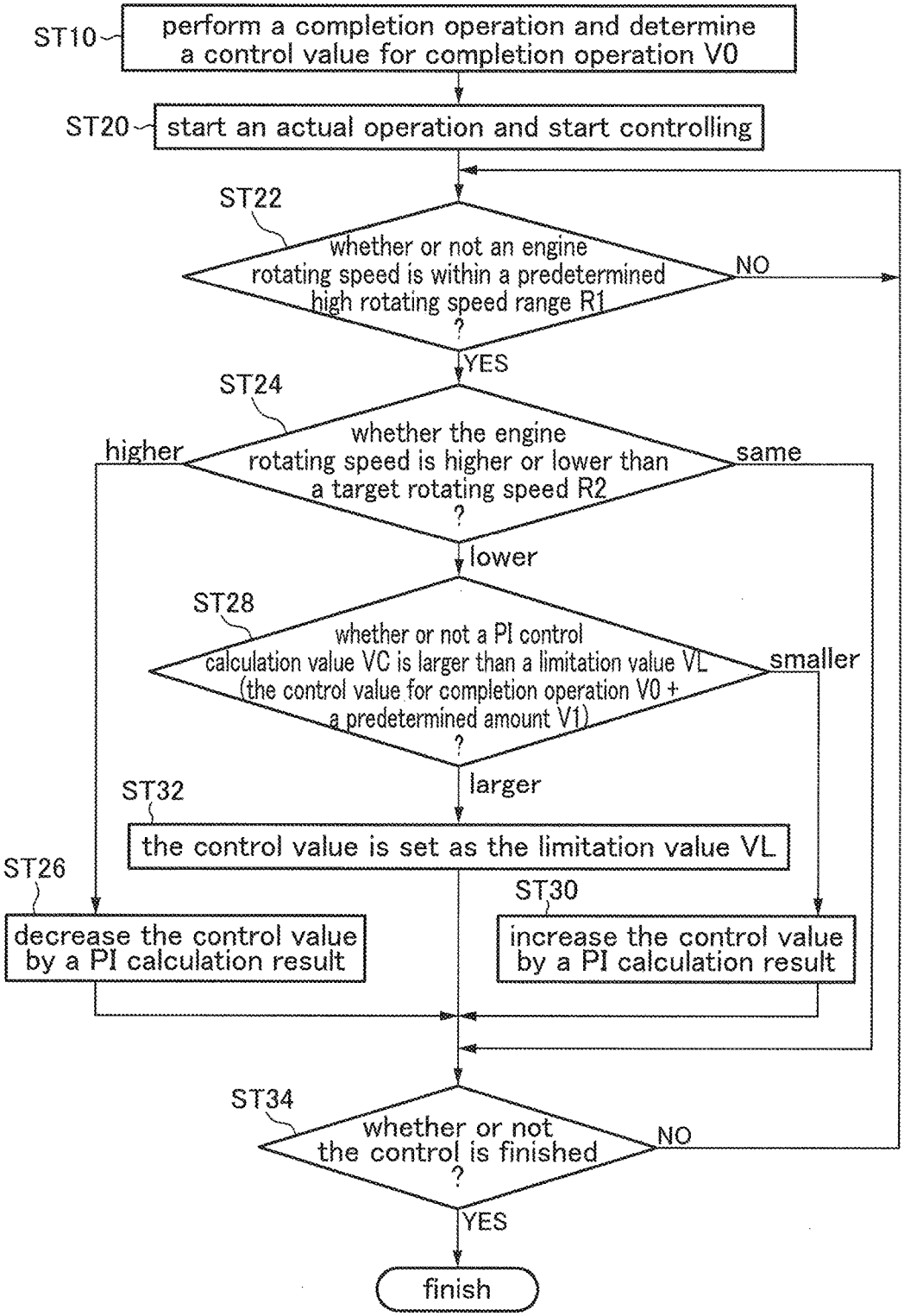
FIG. 3 is a flowchart showing a control method of the handheld engine-driven working machine according to the present invention.

FIG. 3 is a flow chart showing an embodiment of a control method of the handheld engine-driven working machine according to the present invention, and a chain saw which is an embodiment of the handheld engine-driven working machine will be explained from here.

In ST 10, a completion operation (with non-load) is performed in a manufacturing factory with chain blades removed from the chain saw, and a control value for completion operation V0 is determined. Since a control method for determining the control value for completion operation V0 is the same as that for determining an actual operation control value with non-load, an explanation of the former control method is omitted.

In ST 20, an actual operation is started. Concretely, chain blades are attached to the chain saw, and under a circumstance where the working machine is actually used, the engine is started. As an initial value of the control value, the control value for completion operation V0 is used.

In ST 22, it is determined whether or not the rotating speed of the engine 12 is within a predetermined high rotating speed range R1 (for example, 11000-14000 rpm). If the answer is NO, the control is not performed and is returned to ST 22. If the answer is YES, in ST 24, it is determined whether the rotating speed of the engine 12 is higher or lower than a target rotating speed R2 (for example, 12000 rpm).

When the rotating speed of the engine 12 is higher than the target rotating speed R2 (for example, 12000 rpm), in ST 26, the control value is decreased by the result of the PI calculation, so that the opening degree of the solenoid valve 20 is increased, and then the control is moved to ST 34.

When the rotating speed of the engine 12 is the target rotating speed R2 (for example, 12000 rpm), the control is moved to ST 34.

When the rotating speed of the engine 12 is lower than the target rotating speed R2 (for example, 12000 rpm), in ST 28, it is determined whether or not a PI control calculation value VC, which is obtained by increasing the control value by the result of the PI calculation, is larger than a limitation value VL, which is a sum of the control value for completion operation V0 and a predetermined amount V1. When the PI control calculation value VC is smaller than the limitation value VL, in ST 30, the opening degree of the solenoid valve 20 is decreased by increasing the control value by the result of the PI calculation, and then, the control is moved to ST 34. When the PI control calculation value VC equals to or is larger than the limitation value VL, in ST 32, the control value is set to the limitation value VL, and then the control is moved to ST 34. The limitation value VL is smaller than 1000 per mill, preferably, smaller than 900 per mill. Namely, there is no chance for the solenoid valve 20 to be fully closed. Preferably, the predetermined amount V1 is 200 per mill.

In ST 34, it is determined whether the control should be finishes or not. For example, for a certain number of continuous rotations (for example, 5000 rotations), when the fluctuation of the rotating speed of the engine 12 is within a predetermined range (for example, within 1000 rpm) and a number of times of the control implementations reaches a predetermined number of times (30 times), the control value at that time is determines as the actual operation control value, and then the control is finished. Otherwise, the control is moved to ST 22.

Figure 4:
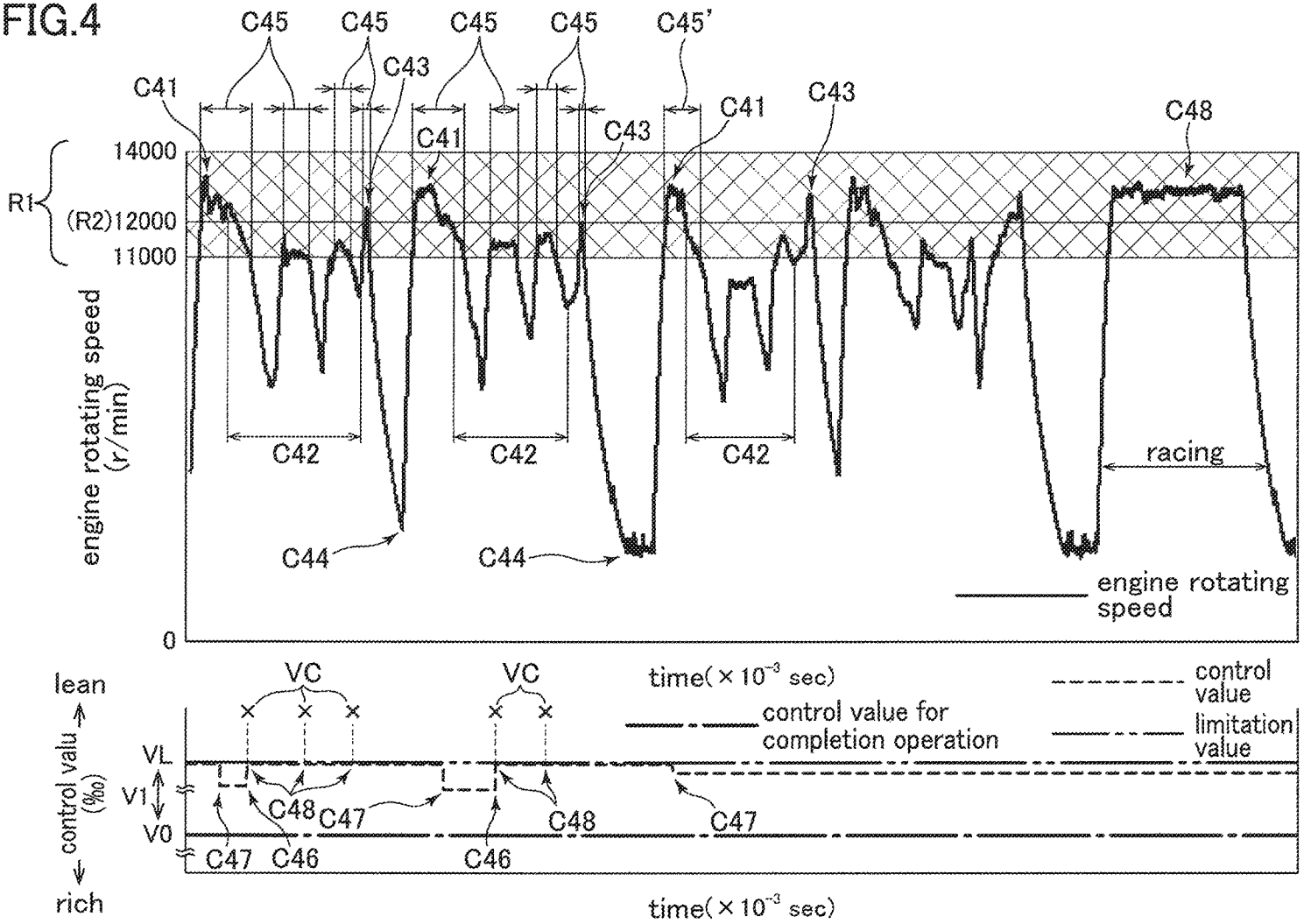
FIG. 4 is a graph showing an example of changes in the engine rotating speed and the control value with respect to time when an actual operation with load is performed with the chain saw according to the present invention.
Figure 5:
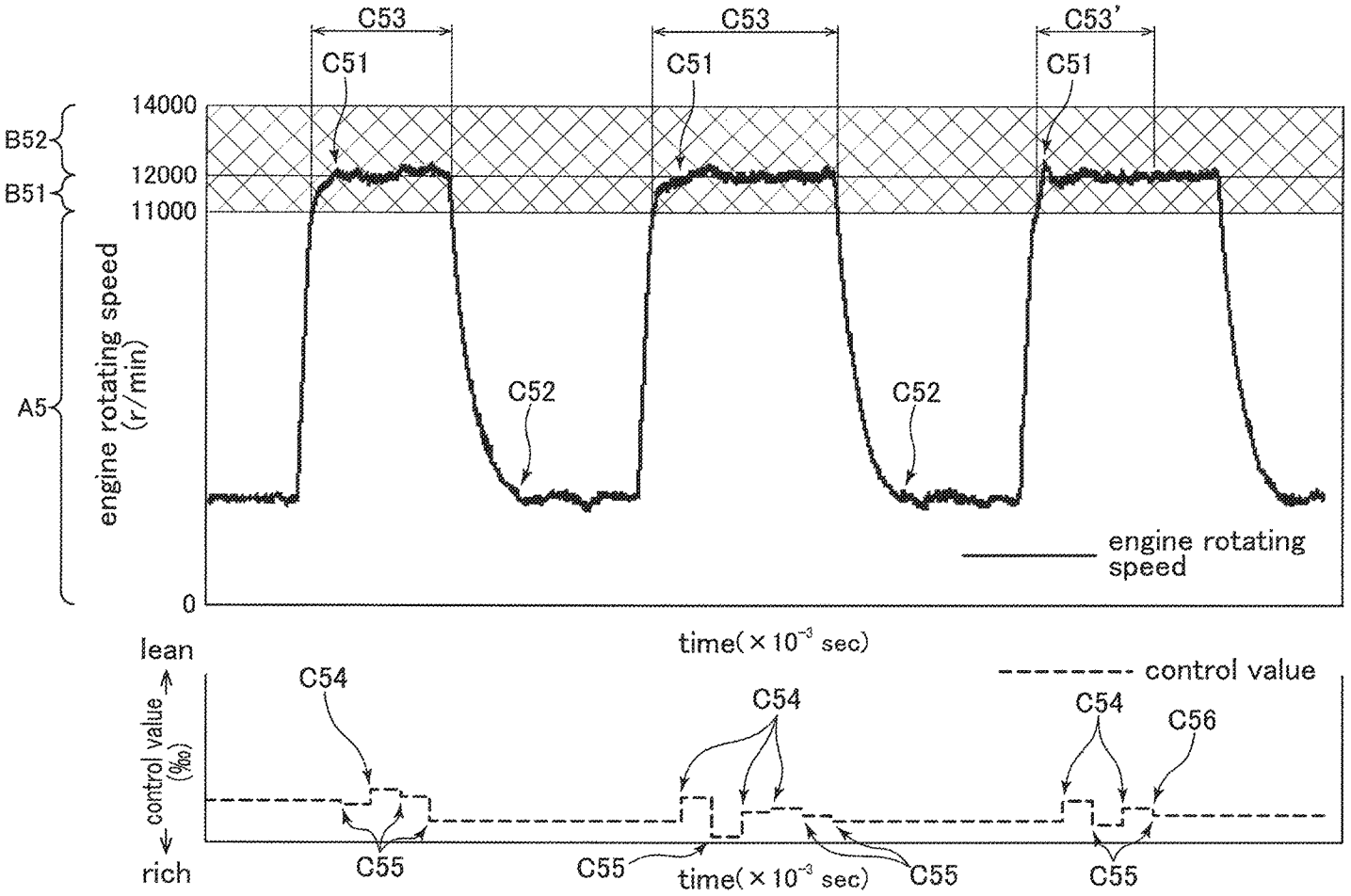
FIG. 5 is a graph showing changes in the engine rotating speed and the control value with respect to time around a time when the actual operation control value was determined in an example in which an actual operation with non-load of the chain saw was performed while the control described in the Patent Publication 1 was performed.

FIG. 4 is a graph showing an example of changes in the engine rotating speed and the control value with respect to time when an actual operation was performed with load by using the chain saw according to the present invention.

In FIG. 4, when the throttle was fully opened, the engine rotating speed was increased beyond 12000 rpm (C41). Then, when the chain saw 10 got started cutting wood and so on (with load), the engine rotating speed was decreased by an amount of load caused by the cutting operation, namely below 12000 rpm which is the target rotating speed, and remained below 12000 rpm during the cutting (C42). After the cutting is finished, the engine rotating speed was increased beyond 12000 rpm (C43), and when the throttle was returned, the engine, rotating speed was decreased to an idling rotating speed (C44). While the rotating speed of the engine 12 was within the predetermined high rotating speed range R1 (11000-14000 rpm, the PI control was performed (C45). Namely, according to whether the rotating speed of the engine 12 was smaller or larger than the predetermined rotating speed R2 (for example, 12000 rpm), the control value was increased (C46) or decreased (C47), respectively. When the control value was decreased, the control value was decreased by the result of the PI calculation. When the control value was increased and the PI control calculation value VC obtained by increasing the control value by the result of the PI calculation became larger than the limitation value, the control value was set to the limitation value VL (C48). In the third operation shown in FIG. 4, since the control value was continuously within the predetermined range (C47), the PI control was finished (C45'), and the control value was determined as the actual operation control value. Thus, in the fourth operation shown in FIG. 4, the PI control was not performed. After that, in the fifth operation shown in FIG. 4, when the actual operation was performed with non-load, the engine stably rotated at around 13000 rpm, and no hunting phenomenon can be found (C48).

Figure 6:
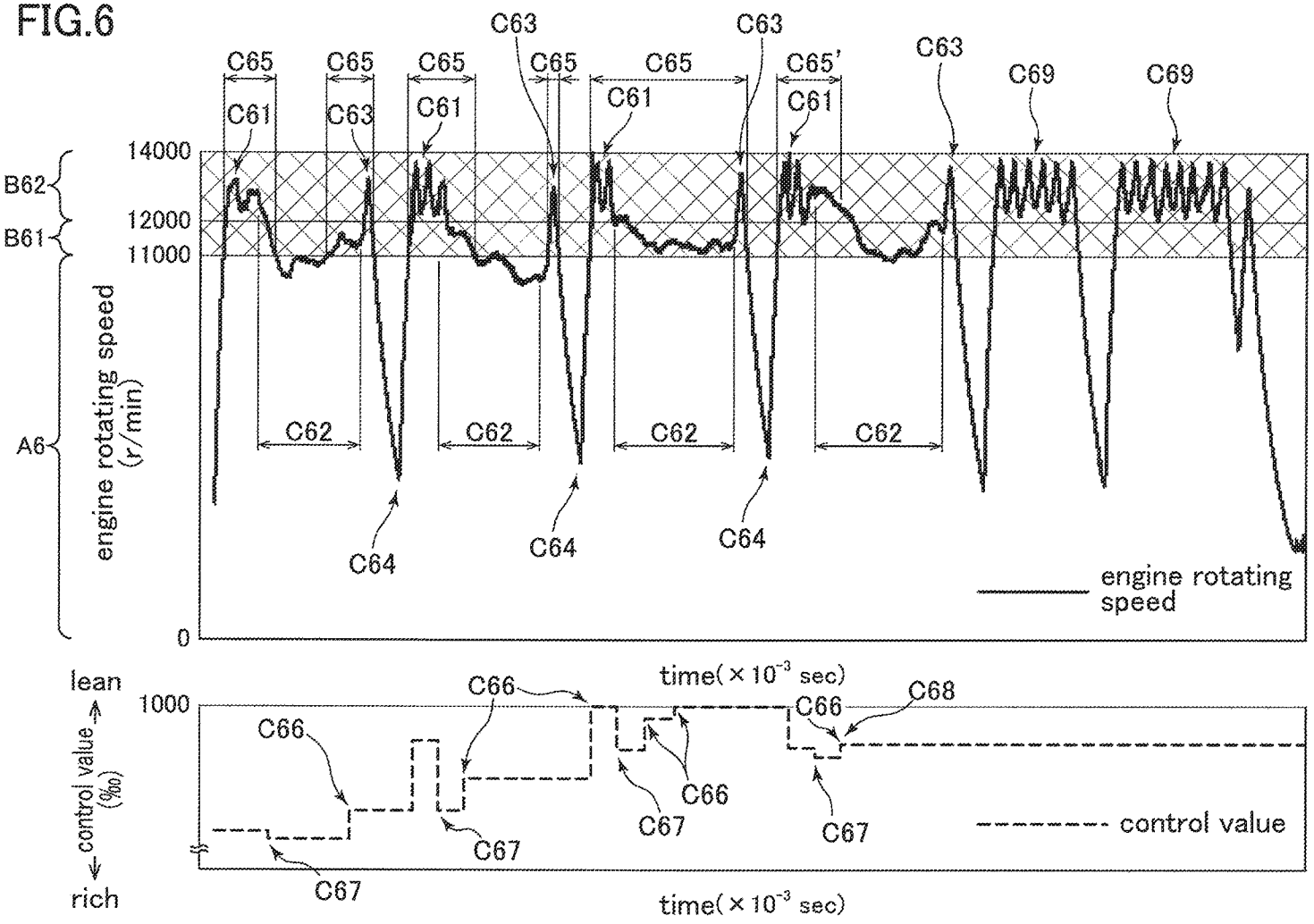
FIG. 6 is a graph showing changes in the engine rotating speed and the control value with respect to time around a time when the actual operation control value was determined in an example in which an actual operation with load of the chain saw was performed while the control described in the Patent Publication 1 was performed.

Further, comparing the actual operation control values (the last control values) in FIGS. 4 and 6, the actual operation control value in FIG. 4 is restricted blow the limitation value VL, while the actual operation control value in FIG. 6 is relatively near 1000 per mill. Namely, the actual operation control value of the chain saw according to the present invention (FIG. 4) can be made closer to the actual operation control value to be determined with non-load than the actual operation control value of the chain saw according to prior art (FIG. 6).

Further, comparing FIG. 4 using the chain saw 10 according to the present invention with FIG. 6 using prior art control, the fluctuations of the rotating speed with non-load are different from each other. Namely, in FIG. 4 using the chain saw 10 according to the present invention, the fluctuation is small and stable, while in FIG. 6 using the prior art control, the fluctuation is large. Thus, the chain saw according to the present invention does not provide an operator with uncomfortable feeling due to the fluctuation of rotation.

As stated above, the limitation value VL (the upper limitation value) is a sum of the control value for completion operation V0 and the predetermined value V1. If the predetermined value V1 is too large, the control is not different from the prior art control. If the predetermined value V1 is too small, an effect of the control may be missed. For example, when a completion operation is performed at a lower ground level and an actual operation is performed at a higher ground level, an amount of supplying fuel is required to be reduced over the entire engine rotating speeds. In this connection, when the predetermined value V1 is too small, the amount of supplying fuel cannot be sufficiently reduced.

Although an embodiment of the present invention has been explained, the present invention is not limited to the embodiment, namely, many kinds of modifications can be done within the scope of the present invention, and it goes without saying that such modifications fall within the scope of the present invention.

What is claimed:

1. An engine-driven working machine comprising:

an engine including an electronically controlled carburetor; and a controller connected to the electronically controlled carburetor;

wherein the electronically controlled carburetor includes a solenoid valve for adjusting an amount of supplying fuel into the electronically controlled carburetor, wherein the controller is programmed to vary a control value of the solenoid valve so as to increase an opening degree of the solenoid valve when a rotating speed of the engine is within a predetermined high rotating speed range and the rotating speed of the engine is higher than a target rotating speed;

wherein the controller is programmed to vary the control value of the solenoid valve to a control calculation value calculated so as to decrease the opening degree of the solenoid valve, when the rotating speed of the engine is within the predetermined high rotating speed range, the rotating speed of the engine is lower than the target rotating speed, and the control calculation value is nearer a fully-opened state than a single limitation value which corresponds to a predetermined opening degree larger than a fully-closed state, and wherein the controller is programmed to set the control value of the solenoid valve to the limitation value when the rotating speed of the engine is within the predetermined high rotating speed range, the rotating speed of the engine is lower than the target rotating speed, and the control calculation value equals to or is nearer the fully-closed state than the limitation value.

2. The engine-driven working machine according to claim 1, wherein the limitation value is determined by varying a control value determined in a completion operation by a predetermined value toward a direction of opening the solenoid valve.

3. The engine-driven working machine according to claim 1, wherein the engine-driven working machine is a chain saw, an engine cutter or a hedge trimmer.

* * * * *